US009228405B2

(12) United States Patent
Smith et al.

(10) Patent No.: US 9,228,405 B2
(45) Date of Patent: Jan. 5, 2016

(54) VELOCITY STRINGS

(75) Inventors: Roddie Smith, Aberdeen (GB); Michael Maclurg, Inverurie (GB); Wolfgang Birner, Winsen (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 350 days.

(21) Appl. No.: 13/478,894

(22) Filed: May 23, 2012

(65) Prior Publication Data

US 2012/0298377 A1 Nov. 29, 2012

(30) Foreign Application Priority Data

May 24, 2011 (GB) ..... 1108648.5

(51) Int. Cl.
*E21B 23/02* (2006.01)
*E21B 33/04* (2006.01)
*E21B 34/10* (2006.01)

(52) U.S. Cl.
CPC ..... *E21B 23/02* (2013.01); *E21B 33/04* (2013.01); *E21B 34/105* (2013.01)

(58) Field of Classification Search
CPC ..... E21B 23/00; E21B 23/01; E21B 23/02
USPC ..... 166/378, 380, 386, 332.8, 322
See application file for complete search history.

(56) References Cited

U.S. PATENT DOCUMENTS

| | | | |
|---|---|---|---|
| 4,583,591 | A | 4/1986 | Krause, Jr. et al. |
| 4,844,166 | A | 7/1989 | Going, III |
| 4,997,038 | A | 3/1991 | Welch |
| 5,027,903 | A | 7/1991 | Gipson |
| 5,398,764 | A | 3/1995 | Collins |
| 2007/0181305 | A1 | 8/2007 | McGavern, III |
| 2008/0087423 | A1 | 4/2008 | Wylie et al. |
| 2008/0271893 | A1 | 11/2008 | Hill |
| 2009/0229834 | A1 | 9/2009 | Bolding |
| 2009/0277643 | A1 | 11/2009 | Mondelli |

FOREIGN PATENT DOCUMENTS

| | | | |
|---|---|---|---|
| EA | 200870408 | A1 | 4/2009 |
| EA | 200601988 | A1 | 9/2014 |
| EP | 2103776 | A2 | 9/2009 |
| GB | 2228506 | A | 8/1990 |
| RU | 2242579 | C2 | 12/2004 |
| RU | 2243361 | C2 | 12/2004 |
| RU | 2284406 | C2 | 9/2006 |
| RU | 65562 | U1 | 8/2007 |
| RU | 2012121352 | | 5/2012 |
| WO | 97/48880 | A2 | 12/1997 |
| WO | 03/054349 | A1 | 7/2003 |

OTHER PUBLICATIONS

Office Action received in corresponding RU Application No. 2012121352, dated Nov. 28, 2013.

(Continued)

*Primary Examiner* — Brad Harcourt
(74) *Attorney, Agent, or Firm* — Blank Rome, LLP

(57) ABSTRACT

A velocity string installation method comprises the steps of: removing an existing safety valve from a production tubing safety valve nipple; running a velocity string into the production tubing to engage the safety valve nipple; and then running a velocity string safety valve into the velocity string and coupling the safety valve with a port at the safety valve nipple.

20 Claims, 6 Drawing Sheets

(56) References Cited

OTHER PUBLICATIONS

Exam Report received in corresponding Australian application 2012202988, dated Jan. 15, 2014.

UK Search Report in counterpart UK Appl. GB1108648.5, dated Jul. 6, 2011.

Further Search Report in counterpart UK Appl. GB1108648.5, dated Aug. 12, 2011.

Decision on Grant received in corresponding application No. 2012121352/03, 5 pages.

Search Report received in corresponding EP Application No. 12169335, dated Jul. 18, 2014, 7 pages.

VELOCITY STRINGS

CROSS-REFERENCE TO RELATED APPLICATIONS

This application claims priority under 35 U.S.C. §119(a) to U.K. Appl. No. GB 1108648.5, filed 24 May 2011.

FIELD OF THE DISCLOSURE

This invention relates to velocity strings and to apparatus, systems and methods related to the provision and use of velocity strings.

BACKGROUND OF THE DISCLOSURE

In the oil and gas industry, wells are drilled to access subsurface hydrocarbon-bearing rock formations. Once the appropriate apparatus is in place in the well and at surface, hydrocarbons may flow from the formation or reservoir to surface. However, over a period of time conditions may change such that the rate of production of hydrocarbons falls or even stops. For example, in gas-producing wells, as the reservoir pressure drops, the velocity of the gas flowing through the production tubing may become insufficient to transport liquids present in the gas to surface. Thus, over time, liquids accumulate in the well and ultimately hinder production.

One established remedial treatment for this situation involves installing a smaller diameter tubing or string inside the existing production tubing, such that the gas travels to surface though the smaller diameter tubing. The reduction in flow area results in an increase in flow velocity sufficient to carry liquids from the wellbore, hence the use of the term "velocity string" to describe the tubing.

Oil and gas wells feature multiple safety systems to prevent uncontrolled release of fluid from the reservoir, including the provision of one or more safety valves in the production tubing which carries the oil or gas to surface. A typical safety valve will be mounted inside the production tubing and will be controllable from surface via one or more hydraulic control lines mounted on the outside of the production tubing. The valve may be a spring-biased flapper valve which, when activated, acts as a check valve and will open to permit flow from surface into the well but will prevent flow from the reservoir to surface.

When a velocity string is installed in a well it is desirable to retain the functionality of the safety valve. Thus one solution is to provide a velocity string dimensioned such that the upper end of the string terminates just below the existing safety valve. The string may be suspended from a packer which is run in and set below the safety valve. If desired, a further velocity string is positioned in an upper section of the well, the lower end of this string terminating just above the safety valve. However, this arrangement has a number of disadvantages, one being the discontinuity in the flow area between the ends of the velocity strings: as the flow leaves the upper end of the lower string the gas velocity will fall, and liquid may drop out of the fluid stream. The presence of the packer also tends to reduce the available flow area.

In some cases it may not be possible to run an appropriate packer through the restriction created by the safety valve. In this situation a velocity string may be provided which passes through the safety valve; however this eliminates the functionality of the safety valve, removing one layer of safety from the well operations.

SUMMARY OF THE DISCLOSURE

According to the present invention there is provided a method of installing a velocity string comprising: running a velocity string into a wellbore; and extending a member or key on the string to engage a profile in a wall of the wellbore and thereby support the string.

Another aspect of the invention relates to a velocity string having a string-supporting key extendable to engage a profile in a wall of a wellbore.

Utilizing a key and profile to support the velocity string may obviate the requirement to provide a packer to engage the wellbore wall and support the string. A packer capable of passing through an existing safety valve and then being expanded or set to suspend a velocity string from the wellbore wall below the safety valve is likely to be of relatively robust construction. As such, the packer will tend to occupy a significant volume and place restrictions on the diameter of the velocity string. For example, it is generally not possible to provide anything larger than a 2⅞ inch velocity string when the string is to be mounted via a packer below the safety valve in 4½ inch production tubing (a step down in diameter of two standard sizes). However, embodiments of the present invention may permit, for example, a 3½ inch velocity string to be mounted in 4½ inch production tubing (a single size reduction). The normal tubing sizes used in completions are: 2⅜"; 2⅞"; 3½"; 4½"; 5"; 5½"; and 7", although 5" tubing is rarely used.

The string may be configured to engage a bore restriction or no-go. The string may include a no-go-engaging member or key and may be configured such that engagement of the key with the no-go causes the profile-engaging key to extend into engagement with a corresponding lock profile. The no-go-engaging key may be configured to retract when the profile-engaging key extends. A typical no-go, such as would be provided in a safety valve nipple, will generally not be configured to support a significant weight, such as the weight of a velocity string. Accordingly, embodiments of the invention may utilise engagement with the no-go as a locating mechanism and further as a mechanism to extend the profile-engaging key; the lock profile associated with the no-go is typically better suited to supporting a significant weight.

The key may be retractable to facilitate or permit retrieval of the string. In one embodiment the application of an upward tension to the string will tend to cause the key to retract.

The profile may be provided in combination with a seal area or honed bore, and thus may form part of a nipple. The profile may be part of a ported or safety valve nipple, that is a nipple provided in combination with a port which may communicate with a control line.

The method may comprise forming a seal with the wall of the wellbore on either side of a port. The string may include seal members configured for location above and below the port to create an isolated volume. The string may be configured to permit fluid communication between the volume and an associated tool or device, such as an insert safety valve or an inflow control valve.

The method may comprise running a device or valve into the wellbore, and the device or valve may be configured to be operatively associated with the velocity string. The device or valve may be run in together with the velocity string, or may be run in separately of the velocity string. An insert safety valve may be run into the wellbore to land in the velocity string, with the valve and string configured such that the valve may be controlled via control lines coupled to a safety valve nipple. Alternatively, or in addition, the valve maybe an inflow control valve configured to permit passage or release of fluid, typically gas. For example a gas cap may gather in the annulus between the upper end of the velocity string and the production tubing and the valve may be opened to allow the gas cap to escape into the velocity string.

The valve may be configured to releasably engage the string, for example the valve may include an extendable key or other member configured to engage a profile formed in the string.

According to the present invention there is provided a velocity string installation method comprising: running a velocity string into production tubing to engage a safety valve nipple; and running a velocity string safety valve into the velocity string and coupling the safety valve with a port at the safety valve nipple.

The safety valve may be coupled with the port via the velocity string.

The method may include the step of first retrieving an existing safety valve from the production tubing.

Another aspect of the present invention relates to a velocity string safety apparatus comprising: a velocity string configured to engage a safety valve nipple; and a safety valve configured to engage the velocity string and communicate with a port at the safety valve nipple.

The foregoing summary is not intended to summarize each potential embodiment or every aspect of the present disclosure.

BRIEF DESCRIPTION OF THE DRAWINGS

These and other embodiments of the present invention will now be described, by way of example, with reference to the accompanying drawings, in which.

DETAILED DESCRIPTION OF THE DRAWINGS

Figure 1:
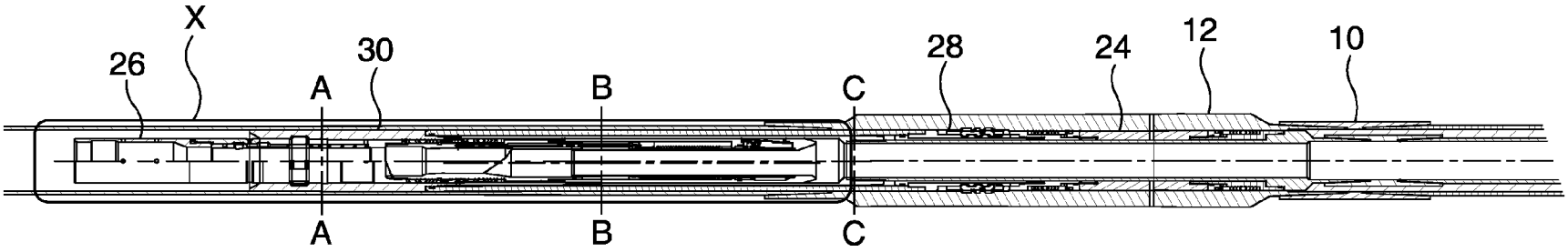
FIG. 1 is a sectional view of a velocity string safety system in accordance with an embodiment of the present invention.

Reference is first made to FIG. 1 of the drawings which illustrates a velocity string safety system in accordance with an embodiment of the present invention.

The figure illustrates a section of a completion or production tubing 10 including a safety valve nipple 12. During normal production, the nipple 12 will accommodate an appropriate safety valve (not shown). As seen more clearly in FIG. 2*c* of the drawings, the nipple 12 includes a no-go 14 and locking profile 16 positioned above sections of honed bore 18, 19 surrounding a port 20 which communicates with a hydraulic control line 22. During normal production, the operation of the safety valve (not shown) will be controlled from the surface via the control line 22.

The figures illustrate the safety valve nipple 12 after the safety valve appropriate for the production tubing 10 has been retrieved and a velocity string 24 and velocity string safety valve 26 run in and installed. The figures only illustrate the upper end of the velocity string 24, which includes a nipple engaging portion 28 and above this a portion 30 configured to receive the safety valve 26.

Figure 2A:
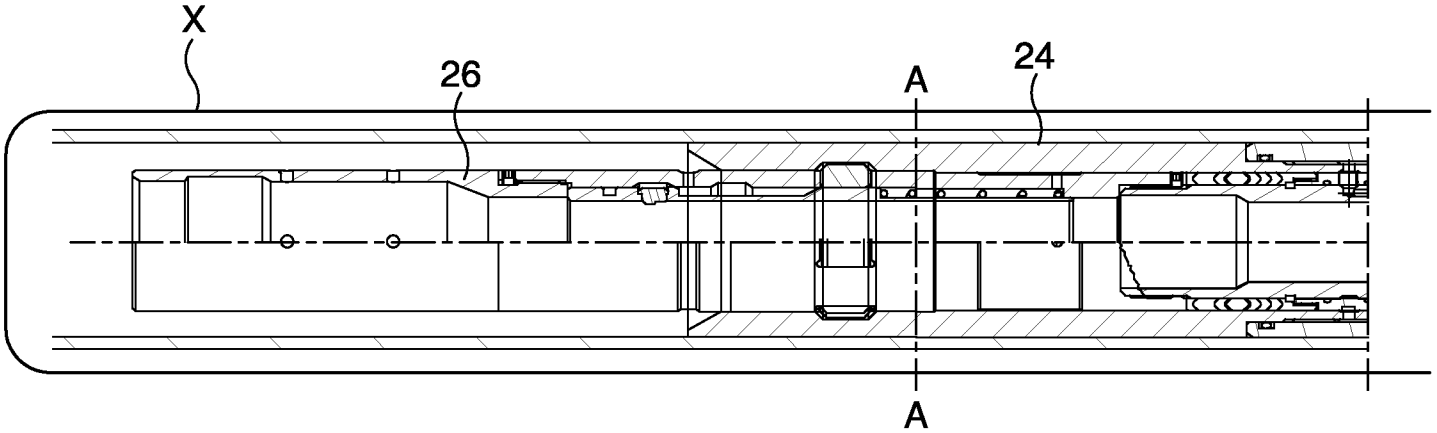
FIGS. 2A through 2D are enlarged views of the system of FIG. 1.
Figure 2B:
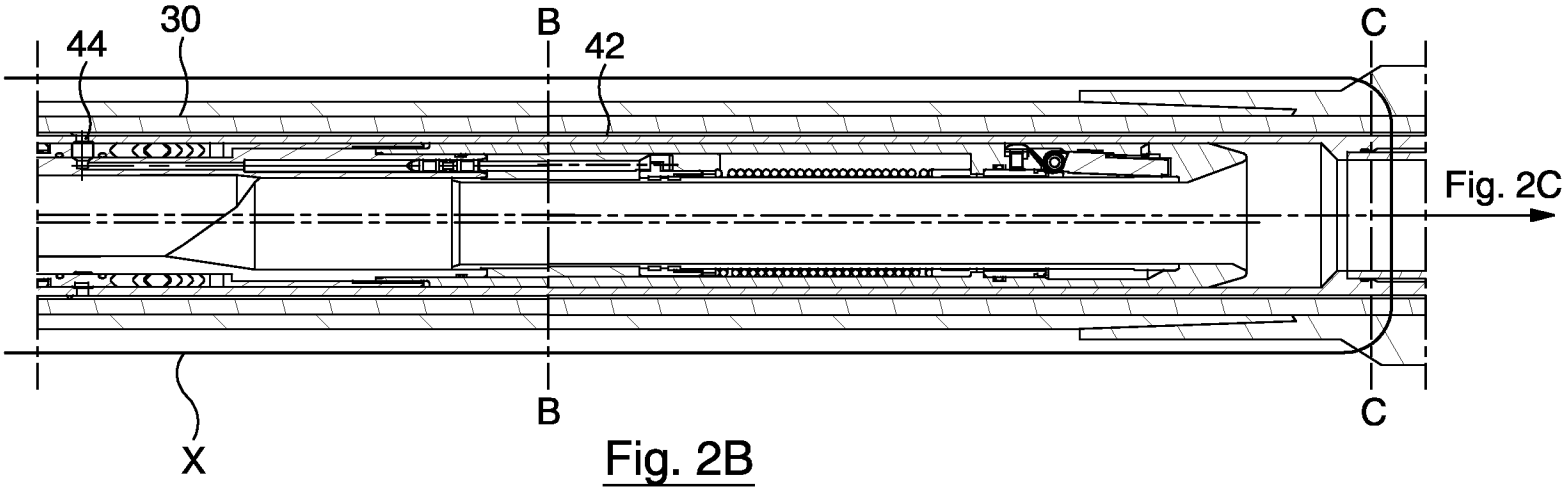
Figure 2C:
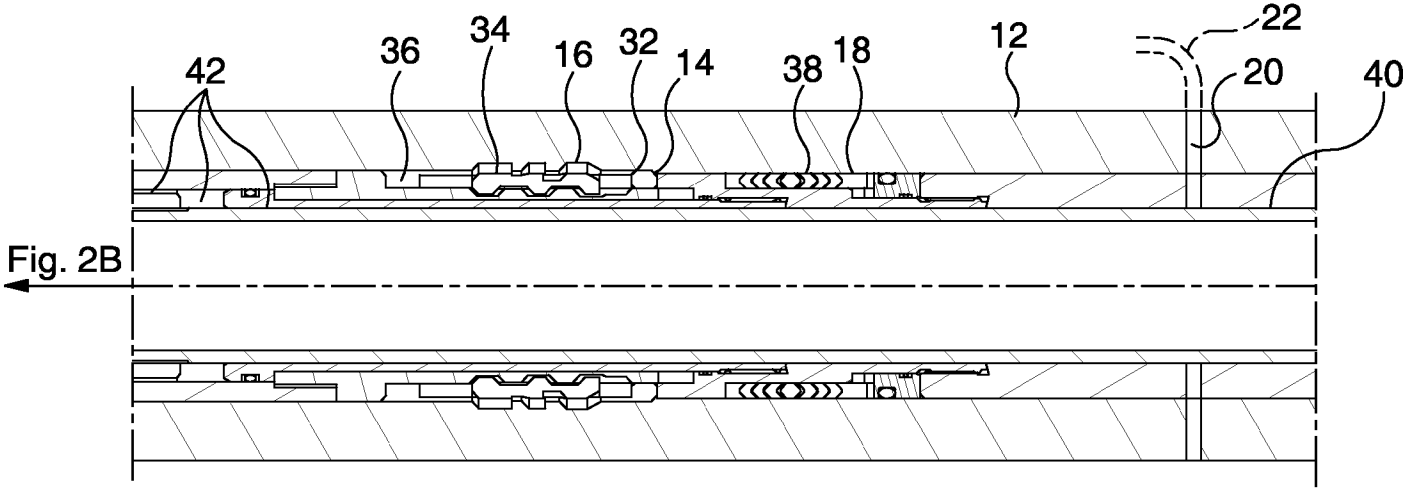
Figure 2D:
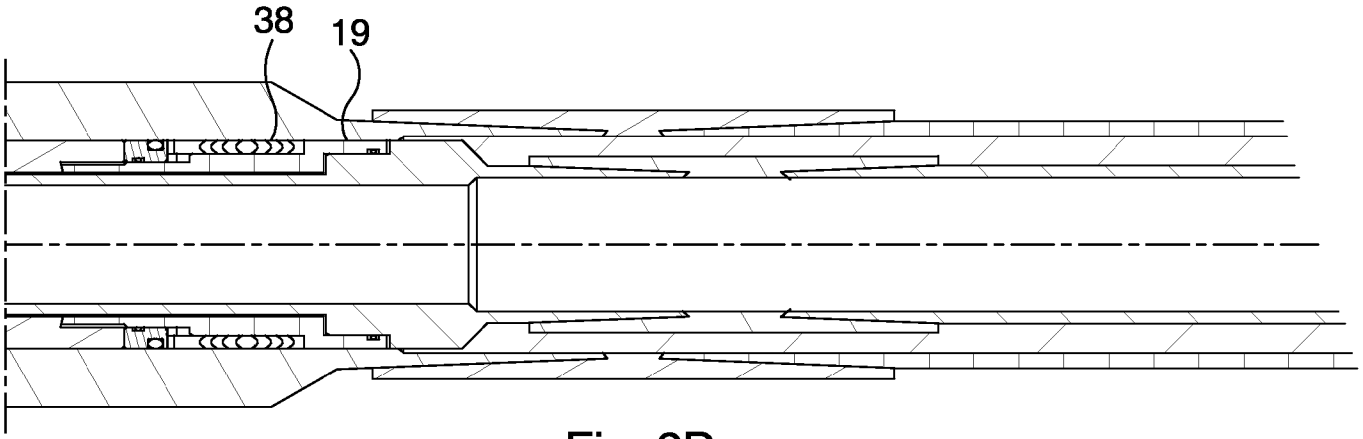

The nipple engaging portion 28 is perhaps best illustrated in FIGS. 2*c* and 2*d* of the drawings and includes a no-go engaging key 32 and a profile engaging key 34. The keys may take any appropriate form and may be, for example, dogs, part-circular segments, or split rings. FIG. 2*c* illustrates the keys 32, 34 in the running configuration and illustrates the positioning of the keys 32, 34 at the instant the no-go engaging key 32 lands on the safety valve nipple no-go 14. The keys 32, 34 form part of an assembly which may move upwards relative to the rest of the velocity string 24, and the keys 32, 34 are also supported by a profiled member 36. The inner faces of the keys 32, 34 and the outer face of the profile member 36 are configured such that, on the key 32 engaging the no-go 14, the weight of the velocity string 24 causes the remainder of the velocity string 24, including the profiled member 36, to continue to move downwards relative to the no-go 14. Thus, the keys 32, 34 travel upwards relative to the profiled member 36 such that the no-go engaging key 32 is retracted while the profile engaging key 34 is extended and retained in the extended position, engaging with the locking profile 14, by the weight of the string 24.

Below the keys 32, 34 the velocity string 24 carries two spaced seals 38 which are dimensioned and located to engage with the honed bore sections 18, 19 of the nipple 12. Thus, the seals 38, in combination with the outer surface of the string 24 and the inner surface of the nipple 12 form an isolated annulus 40 in communication with the safety valve nipple port 20. The velocity string 24 is configured to define a fluid passage 42 linking the annulus 40, and thus the port 20 and the control line 22, to a port 44 in the safety valve receiving portion 30 (see FIG. 2*b*).

Figure 3A:
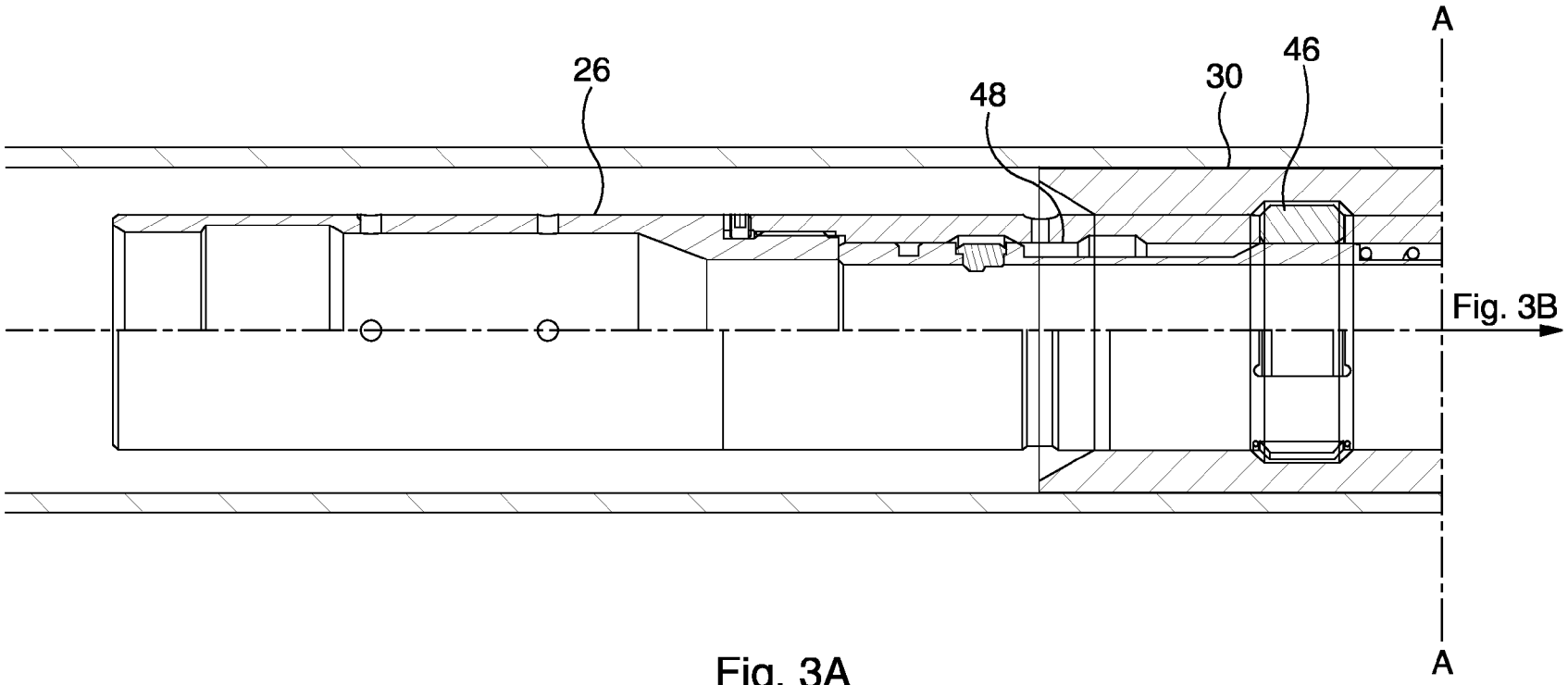
FIGS. 3A through 3C are further enlarged views of a safety valve of the system of FIG. 1.
Figure 3B:
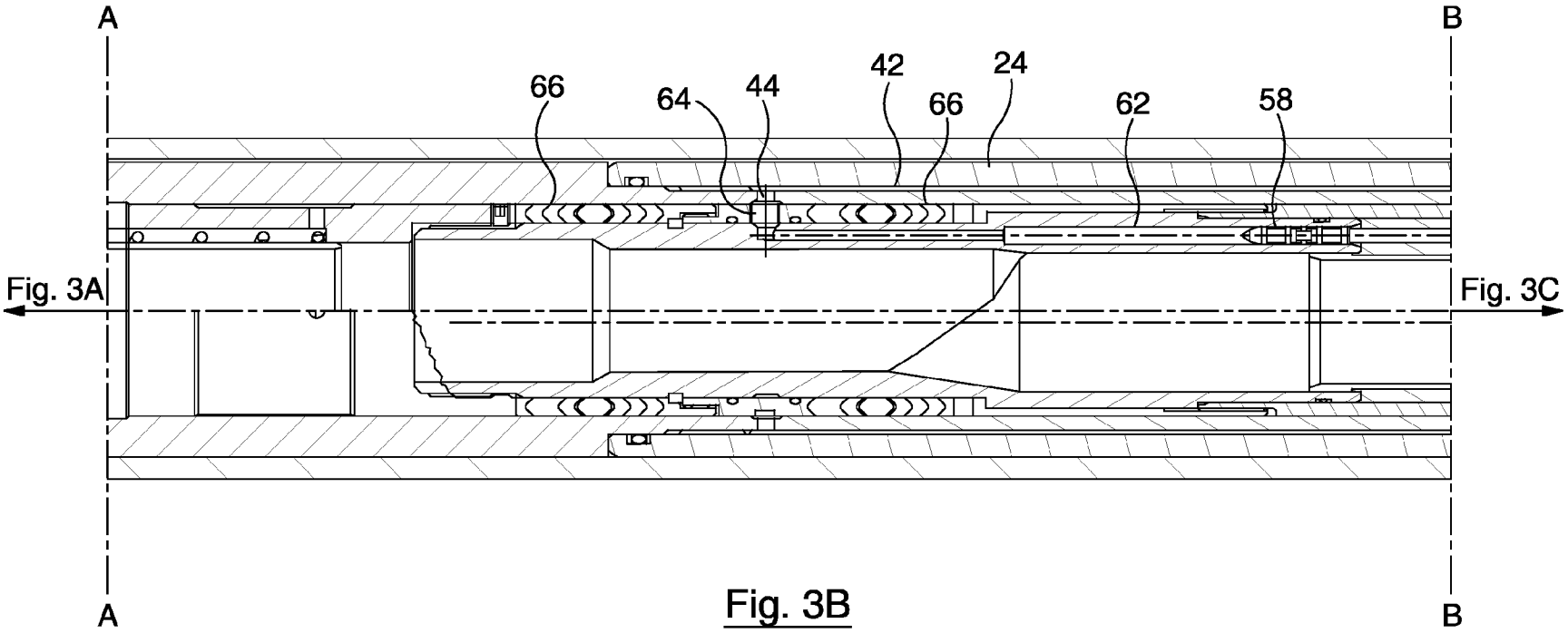
Figure 3C:
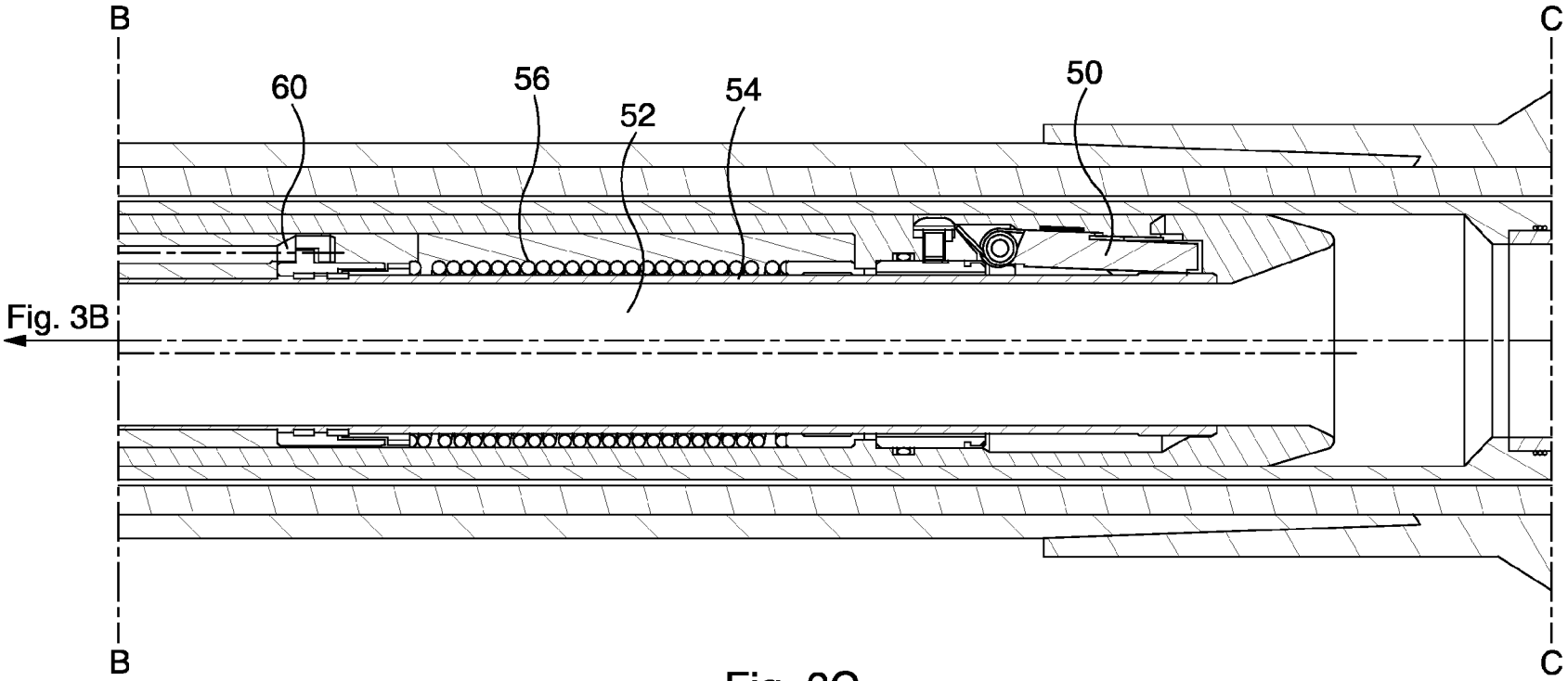

Reference is now also made to FIGS. 3*a* through 3*c* which illustrate the safety valve 26 in greater detail. As noted above, the safety valve 26 will generally be run into the well after the velocity string 24 has been secured in the nipple 12. The valve 26 includes an arrangement of keys 46 and profiled sprung sleeves 48 which may be manipulated to secure the valve 26 in the upper end of the string 24.

The valve 26 includes a sprung flapper 50 (see FIG. 3*c*) which is biased to close the valve through bore 52 although the figures illustrate the flapper restrained behind a lockout sleeve 54. A spring 56 biases the sleeve 54 towards a retracted position, allowing the flapper 50 to close. However, the sleeve 54 may be retained in the illustrated extended position by hydraulic fluid pressure acting on the upper end of a piston 58 coupled through an appropriate linkage 60 to the upper end of the sleeve 54. The piston 58 is moveable in an elongate cylindrical piston chamber 62 which is in fluid communication with a port 64 in the valve body, which port 64 is aligned with the velocity string port 44. Seals 66 are provided on the valve body above and below the port 64 to provide a sealing engagement with the opposing inner diameter of the string 24.

In use, an operator will be monitoring production from the well and will have identified conditions indicating that provision of a velocity string would be beneficial. For example, in a depleting gas well the velocity of the gas flowing from the reservoir to surface may have decreased to the extent that the gas flow is unable to entrain liquid, leading to a build up of liquid in the well. In this situation the operator will first retrieve the safety valve which would originally be mounted in the safety valve nipple 12. The velocity string 24 is then run into the well. As described above, on the no-go engaging key 32 engaging the nipple no-go 14, the profile engaging key 34 is forced outwards to engage with the locking profile 16, thus securing and supporting the string 24 in the production tubing 10. The safety valve 26 is then run into the upper end of the velocity string 24. The combined assembly is arranged such that the control lines 22 are in communication with the safety valve 26 and the operator thus has full control of the safety valve 26 from surface.

It will be apparent to those of skill in the art that the ability to utilize the safety valve nipple 12 to hang the velocity string 24 in the production tubing 20 allows the velocity string 24 to be securely retained while still maintaining a relatively large string flow diameter. This contrasts with conventional arrangements, in which the requirement to provide a separate packer, which has to pass through the existing safety valve and then expand sufficiently to engage the production tubing below the safety valve, restricts the maximum internal flow area of the velocity string. As a result, the velocity string flow may be smaller than that required to provide for liquid lift from the well.

In addition, the ability to utilize the existing hydraulic systems ensures that the safety valve functionality is maintained.

It will be apparent to those of skill in the art that the above described embodiment is merely exemplary of the present invention and that various modifications and improvements may be made thereto without departing from the scope of the present invention. For example, rather than or in addition to controlling the operation of a safety valve 26 as described above, the system may incorporate an inflow control device (ICD) or valve located in the velocity string below the safety valve nipple 12. The ICD may be coupled to the existing hydraulics such that the ICD may be controlled from the surface and be opened from time to time to, for example, to allow removal of any gas cap that forms in the annulus between the velocity string 24 and the production tubing 10.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

We claim:

1. A method of installing a velocity string comprising:

running a velocity string into a wellbore;

engaging a no-go-engaging key with a no-go provided in a nipple; and extending a profile-engaging key on the velocity string to engage a corresponding lock profile in a wall of the nipple and thereby support the velocity string, wherein engaging the no-go-engaging key with the no-go causes the profile-engaging key to extend into engagement with the lock profile.

2. The method of claim 1, wherein the no-go-engaging key retracts when the profile-engaging key extends.

3. The method of claim 1, comprising one of:

the lock profile forms part of a nipple and is provided in combination with a seal area; and the lock profile forms part of a safety valve nipple and is provided in combination with a seal area and a port in communication with a control line.

4. The method of claim 1, comprising one of:

forming a seal between the velocity string and the wall of the nipple on either side of a port;

forming a seal between the velocity string and the wall of the nipple on either side of a port and locating seal members on the velocity string above and below the port to create an isolated volume; and forming a seal between the velocity string and the wall of the nipple on either side of a port and locating seal members on the velocity string above and below the port to create an isolated volume, and providing fluid communication between the isolated volume and at least one associated device.

5. The method of claim 4, wherein the at least one associated device comprises at least one of: a safety valve and an inflow control valve.

6. The method of claim 1, comprising running a device into the wellbore and operatively associating the device with the velocity string.

7. The method of claim 6, wherein running the device into the wellbore and operatively associating the device with the velocity string comprises at least one of:

running the device in together with the velocity string; and running the device in separately of the velocity string.

8. The method of claim 1, wherein running the velocity string into the wellbore comprises at least one of:

landing the velocity string in a safety valve nipple, running a safety valve into the wellbore, and landing the safety valve in the velocity string, wherein the safety valve and the velocity string are configured such that the safety valve is controllable via a control line coupled to the safety valve nipple;

landing the velocity string in a safety valve nipple and running an inflow control valve into the wellbore, wherein the inflow control valve and the velocity string are configured such that the inflow control valve is controllable via a control line coupled to the safety valve nipple; and running the velocity string into production tubing of a standard size, wherein the velocity string is of a next smallest standard size.

9. The method of claim 1, wherein the nipple comprises a ported or safety valve nipple including a port in communication with a control line and the lock profile forms part of the safety valve nipple.

10. A velocity string having a string-supporting profile-engaging key extendable to engage a corresponding lock profile in a wall of a nipple and a no-go-engaging key configured to engage a no-go provided in the nipple, wherein engaging the no-go-engaging key with a no-go causes the profile-engaging key to extend into engagement with the lock profile.

11. The string of claim 10, wherein the no-go-engaging key is configured to retract when the string-supporting key extends.

12. The string of claim 10, wherein the string is configured to engage a safety valve nipple.

13. The string of claim 10, comprising external seal members spaced relative to the profile-engaging key, and wherein the lock profile is on a safety valve nipple, whereby on the profile-engaging key engaging the lock profile on the safety valve nipple, the seal members locate above and below a port in the safety valve nipple to create an isolated volume.

14. The string of claim 13, wherein the velocity string is configured to permit fluid communication between the isolated volume and an associated device.

15. The string of claim 10, wherein the string is configured to at least one of:

receive a safety valve; and receive a safety valve and permit hydraulic actuation of the safety valve via a fluid passage in the velocity string.

16. The string of claim 10, further comprising at least one of:

a safety valve configured to be received in the velocity string; and a safety valve nipple configured to receive the velocity string.

17. A velocity string installation method comprising:

running a velocity string into production tubing to engage a safety valve nipple;

running a velocity string safety valve into the velocity string; and coupling the velocity string safety valve with a port provided through a wall of the safety valve nipple.

18. The method of claim 17, comprising at least one of:

coupling the velocity string safety valve with the port via the velocity string; and first retrieving an existing safety valve from the production tubing.

19. A velocity string safety apparatus comprising:

a velocity string configured to engage a safety valve nipple; and a velocity string safety valve configured to engage the velocity string and communicate with a port provided through a wall of the safety valve nipple.

20. The string of claim 19, wherein the apparatus is configurable to couple the safety valve with the port via the velocity string.

* * * * *